US007719479B2

(12) United States Patent
Hsu et al.

(10) Patent No.: US 7,719,479 B2
(45) Date of Patent: May 18, 2010

(54) ANTENNA ARRAY

(75) Inventors: Cheng-Hsuan Hsu, Taipei (TW); Tsung-Wen Chiu, Taipei (TW); Fu-Ren Hsiao, Taipei (TW); Po-Sheng Chen, Taipei (TW)

(73) Assignee: Advanced Connectek, Inc., Taipei (TW)

( * ) Notice: Subject to any disclaimer, the term of this patent is extended or adjusted under 35 U.S.C. 154(b) by 194 days.

(21) Appl. No.: 12/128,624

(22) Filed: May 29, 2008

(65) Prior Publication Data

US 2008/0316137 A1 Dec. 25, 2008

(30) Foreign Application Priority Data

Jun. 23, 2007 (TW) ..... 96122770 A

(51) Int. Cl.
*H01Q 1/48* (2006.01)

(52) U.S. Cl. ..... 343/848; 343/830; 343/846

(58) Field of Classification Search ..... 343/848, 343/830, 849, 829, 846, 847
See application file for complete search history.

(56) References Cited

U.S. PATENT DOCUMENTS 4,924,237 A * 5/1990 Honda et al. ..... 343/702
5,184,143 A * 2/1993 Marko ..... 343/749
5,526,003 A * 6/1996 Ogawa et al. ..... 343/700 MS
5,621,419 A * 4/1997 Meek et al. ..... 343/770
7,046,203 B2 * 5/2006 Yuanzhu ..... 343/700 MS
2005/0116875 A1 * 6/2005 Yuanzhu et al. ..... 343/846

* cited by examiner

*Primary Examiner*—Tho G Phan
(74) *Attorney, Agent, or Firm*—Jianq Chyun IP Office

(57) ABSTRACT

An antenna array includes five grounding plates, a signal transmission part, two radiation conductors, and a signal feed cable. The first and fifth grounding plates located at the same plane are substantially perpendicular with the second and fourth grounding plates respectively. The second and fourth grounding plates respectively connected to the first and fifth grounding plates extend with the same direction and have two holes or grooves. The third grounding plate connected between the second and fourth grounding plates is substantially perpendicular with the second and fourth grounding plates. The signal transmission part passing through the two holes or grooves is substantially perpendicular with the second and fourth grounding plates. The signal transmission part is connected between the two radiation conductors. The signal feed cable includes a central conductor connected to the signal transmission part and an outer conductor connected to the third grounding plate.

12 Claims, 6 Drawing Sheets

ANTENNA ARRAY

CROSS-REFERENCE TO RELATED APPLICATION

This application claims the priority benefit of Taiwan application serial no. 96122770, filed on Jun. 23, 2007. The entirety of the above-mentioned patent application is hereby incorporated by reference herein and made a part of this specification.

BACKGROUND OF THE INVENTION

1. Field of Invention

The present invention generally relates to an antenna array, and more particularly to an antenna array with a simple production process and lower side lobe energy dissipation of its radiation pattern.

2. Description of Prior Art

Currently, the conventional antenna array includes a grounding plate, radiation conductors, a signal transmission part, and a signal feed cable. Wherein, the radiation parts are set on the top side of the grounding plate, and the signal transmission part is connected between the radiation conductors. The signal feed cable includes a central conductor connected to the signal transmission part and an outer conductor connected to the grounding plate. The signal feed cable is used to feed the high frequency signal into the conventional antenna array.

The high frequency signal may leak its energy when transmitting in the signal transmission part, and thus an energy loss occurs. Further, because the signal transmission part and the radiation conductors of the conventional antenna array are sited at the same side of the grounding plate, the radiation pattern of the conventional antenna array may be interfered by the leaking energy. Thus, the energy of the side lobe in the radiation pattern of the conventional array may increase, and according to the law of the energy conservation, the increasing of the energy of the side lobe decreases the signal level of the main lobe of the conventional antenna array. Furthermore, when the distance between the signal transmission part and the grounding plate is large, the input impendence of the conventional antenna array may be large too, and thus the impendence match of the conventional antenna is hard to be achieved. Accordingly, the signal transmission part of the conventional antenna array may be bent to approach the grounding plate. Thus, the transmission impendence of the signal transmission part may be lowered, and the impendence match may be achieved.

Contrary to the design of making the signal transmission part approach to the grounding plate, the efficiency of the radiated signal of the conventional antenna array may increase when the distance between the radiation conductors and the grounding plate increases. That is, the gain of the whole radiated signal may be enhanced when the distance between the radiation conductors and the grounding plate is large.

The radiation conductors and the signal transmission part are connected to each other, but the design of the distance between the radiation conductors and the grounding plate and the design of the distance between the signal transmission part and the grounding plate are opposite to each other. Therefore, the radiation conductors and the signal transmission part must be sited on the different heights, and the difficulty of producing the conventional antenna array may increase. Thus the impendence of the conventional antenna array may be hard to adjust and match, the stability of conventional antenna array may decrease, and the production cost of the conventional antenna array may increase. In addition, for the conventional antenna array, the isolation level of the radiation conductors may decrease when the distance between the radiation conductors is too short. That is, the interference thereof may occur, and the radiation pattern of the conventional antenna array is affected.

In order to solve these and other problems as stated above, the exemplary embodiment of the present invention provides an antenna array with a simple production process and lower side lobe energy dissipation of its radiation pattern.

SUMMARY OF THE INVENTION

Accordingly, the exemplary embodiment of present invention is directed to an antenna array. The antenna array lowers the leaking energy of its signal transmission part, and thus the interference to the radiation pattern of the antenna array is decreased. Therefore, the energy dissipation of the side lobe of the antenna array is decreased, and the radiated signal level is enhanced.

The antenna array provided by the exemplary embodiment of the present invention has a simple producing process and flexibility for adjusting the impendence of the antenna array. Therefore, the stability of the antenna array is increased, and the producing cost thereof is decreased.

Further, for the antenna array provided by the exemplary embodiment of the present invention, the distance between its radiation conductors is increased, and thus the interference between the radiation conductors is decreased. Therefore, the energy of the main lobe in the radiation pattern is increased.

The exemplary embodiment of the present invention provides an antenna array. The antenna array comprises a plurality of grounding plates, a signal transmission part, a first radiation conductor, a second radiation conductor, and a signal feed cable. Wherein, the plurality of grounding plates comprises a first, second, third, fourth, and fifth grounding plates. A first hole (or groove) and a second hole (or groove) are sited on the second and fourth grounding plates respectively. The first and fifth grounding plates are located at a same plane. The second and fourth grounding plates are connected to the first and fifth grounding plates respectively, and substantially perpendicular with the first and fifth grounding plates respectively. The second and fourth grounding plates substantially extend with a same direction. The third grounding plate is connected the between the second and fourth grounding plates and substantially perpendicular with the second and fourth grounding plates. The signal transmission part has a first and second ends and passes through the first and second holes (or grooves), and a direction from the first end to the second end is substantially perpendicular with the second and fourth grounding plates. The first radiation conductor is connected to the first end and substantially parallel with the first grounding plate. The second radiation conductor is connected to the second end and substantially parallel with the fifth grounding plate. The signal feed cable comprises a central conductor connected to the signal transmission part and an outer conductor connected to the third grounding plate.

According to an exemplary embodiment of the present invention, the antenna array further comprises at least a first supporting pillar and at least a second supporting pillar. Wherein, the first supporting pillar set between the first radiation conductor and the first grounding plate is adapted for supporting the first radiation conductor. The second supporting pillar set between the second radiation conductor and the fifth grounding plate is adapted for supporting the second radiation conductor.

According to an exemplary embodiment of the present invention, the antenna array further comprises a sixth and seventh grounding plates. Wherein, the sixth grounding plate connected to the first grounding plate is substantially perpendicular with the first grounding plate. The seventh grounding plate connected to the fifth grounding plate is substantially perpendicular with the fifth grounding plate. The sixth and seventh grounding plates are substantially parallel with the second and fourth grounding plates, and a direction which the sixth grounding plate extends is substantially same as a direction which the seventh grounding plate extends.

According to an exemplary embodiment of the present invention, an opening direction of the first groove is substantially same as or opposite to an opening direction of the second groove.

Accordingly, since the signal transmission part passes through the first and second holes (or grooves) to connect with the first and second radiation conductors, the signal transmission part is surrounded by the second, third, and fourth grounding plates. Consequently, the leaking energy of the signal transmission part is substantially blocked by the second, third, and fourth grounding plates, and the leaking energy of the signal transmission part affects the radiation pattern less. Furthermore, the leaking energy of the side lobe is decreased, and the gain of the radiated signal is enhanced. When the first and second radiation is distant from the first and fifth grounding plates, the signal transmission part is near the third grounding plate, so as to achieve the better radiation efficiency of the antenna array and flexibility for adjusting the impendence of the antenna array.

Further, the first and second radiation conductors are respectively connected to the first and second ends of the signal transmission part. Thus, the first and second radiation conductors are isolated by the second, third, and fourth grounding plates, and the interference between the he first and second radiation conductors is decreased by this arrangement.

The first and second supporting pillars are made by insulating materials. If the signal transmission touches the second and fourth grounding plates, the part the performance of the antenna array will perform badly. Thus, using the first and second supporting pillars can prevent the signal transmission part from touching the second and fourth grounding plates, so as to achieve the better performance of the antenna array.

The first radiation conductor is surrounded by the second and sixth grounding plates, and the second radiation conductor is surrounded by the fourth and seventh grounding plates, hence the radiations of the first and second radiation conductors are more focusing and not dispersing divergently.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
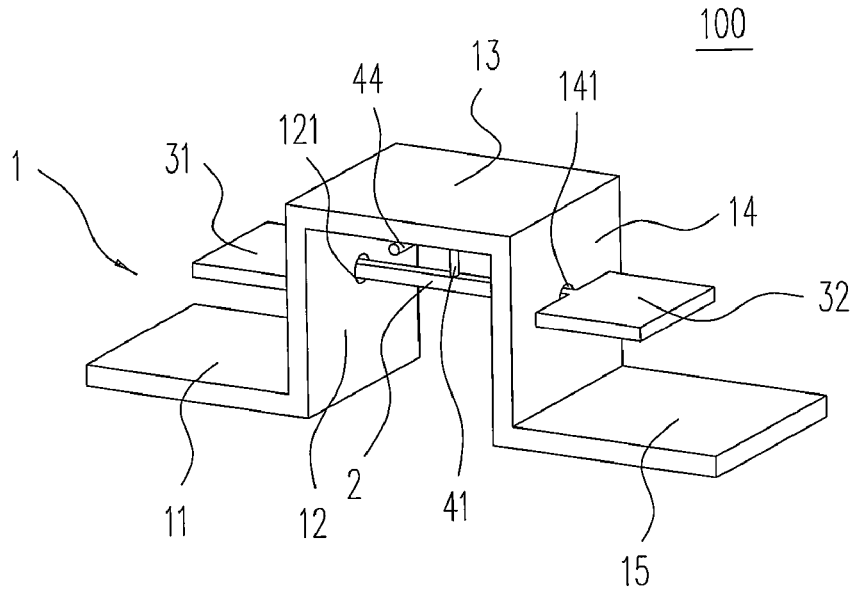
FIG. 1 is a solid schematic diagram showing an antenna array 100 provided by one exemplary embodiment of the present invention.

Reference will now be made in detail to the present preferred embodiment of the invention, examples of which are illustrated in the accompanying drawings. Wherever possible, the same reference numbers are used in the drawings and the description to refer to the same or like parts.

Figure 2A:
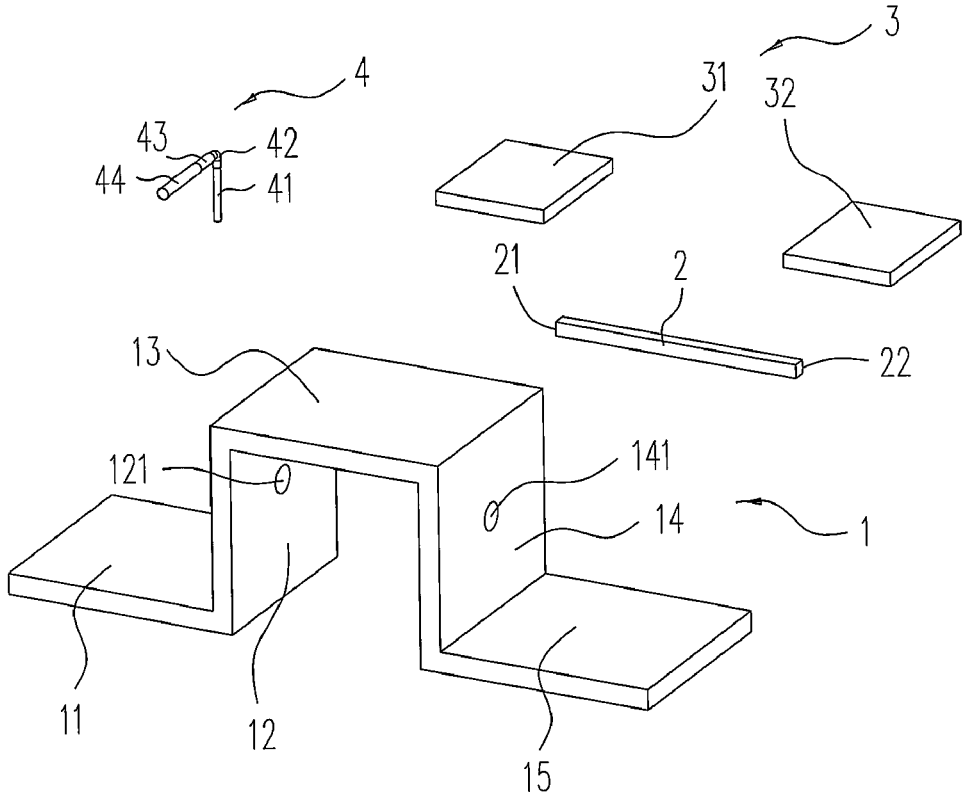
FIG. 2A is an explosive schematic diagram showing the decomposition of the antenna array 100 provided by one exemplary embodiment of the present invention.

Referring to FIGS. 1 and 2A, FIG. 1 is a solid schematic diagram showing an antenna array 100 provided by one exemplary embodiment of the present invention, and FIG. 2A is an explosive schematic diagram showing the decomposition of the antenna array 100 provided by one exemplary embodiment of the present invention. The antenna array 100 comprises a plurality of grounding plates 1, a signal transmission part 2, two radiation conductors 3, and signal feed cable 4.

Wherein, the antenna array the plurality of grounding plates 1 comprise a first grounding plate 11, a second grounding plate 12, a third grounding plate 13, a fourth grounding plate 14, and a fifth grounding plate 15. Two holes 121, 141 are sited on the second grounding plate 12 and the fourth grounding plate 14 respectively. The first grounding plate 11 and the fifth grounding plate 15 are located at the same plane. The second and fourth grounding plates 12, 14 are connected to the first and fifth grounding plates 11, 15 respectively, and substantially perpendicular with the first and fifth grounding plates 11, 15 respectively. The second and fourth grounding plates 12, 14 substantially extend with a same direction. The two sides of third grounding plate 13 are connected with the second and fourth grounding plates 12, 14 and substantially perpendicular with the second and fourth grounding plates 12, 14. In the practical producing process, the plurality of grounding plates can be made by a single metal sheet member, and then the single metal sheet member is bent to form the first, second, third, fourth, and fifth grounding plates 11, 12, 13, 14, 15 in order.

The signal transmission part 2 is can be a rectangular member passing through the two holes 121, 141, and a direction from the end 21 of the signal transmission part 2 to the end 22 of the signal transmission part 2 is substantially perpendicular with the second and fourth grounding plates 12, 14.

The two radiation conductors 2 comprise two radiation conductors 31 and 32. The radiation conductor 31 is connected to the end 21 and substantially parallel with the first grounding plate 11. The radiation conductor 32 is connected to the end 22 and substantially parallel with the fifth grounding plate 15. In this embodiment, the radiation conductors 31 and 32 are rectangular radiation conductors, however the implementation of the radiation conductors 31 and 32 is not intended to limit the scope of the present invention.

Figure 2B:
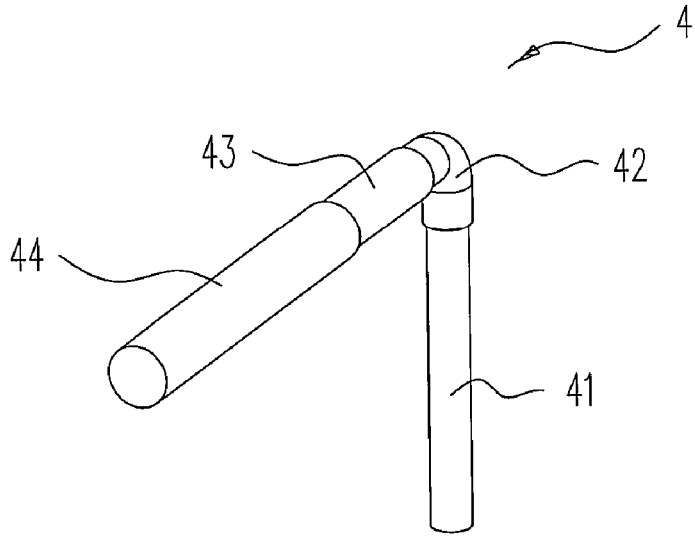
FIG. 2B is a solid schematic diagram showing the signal feed cable 4 of the antenna array 100 provided by one exemplary embodiment of the present invention.
Figure 2C:
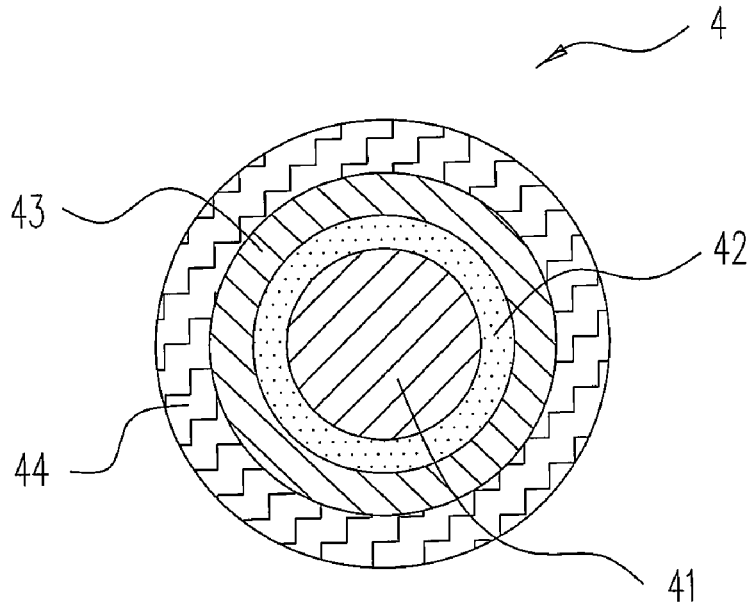
FIG. 2C is sectional schematic diagram showing the signal feed cable 4 of the antenna array 100 provided by one exemplary embodiment of the present invention.

Please see FIGS. 1, 2B and 2C, FIG. 2B is a solid schematic diagram showing the signal feed cable 4 of the antenna array 100 provided by one exemplary embodiment of the present invention, and FIG. 2C is sectional schematic diagram showing the signal feed cable 4 of the antenna array 100 provided by one exemplary embodiment of the present invention. From inner to outer, the signal feed cable 4 comprises a central conductor 41, a first isolation layer 42, an outer conductor 43, and a second isolation layer 44. Wherein, the central conductor 41 is connected to the signal transmission part 2, and the outer conductor 43 is connected to the third grounding plate 13. In this embodiment, the position where the central conductor 41 is connected to the signal transmission part 2 is between the second and fourth grounding plates 12, 14.

In the embodiment, when the radiation conductors 3 is far away from the first grounding plate 11, the distance between the radiation conductors 3 and the first grounding plate 11 increases, so as to letting the signal transmission part 2 close to the third grounding plate 13. Thus, the radiation efficiency of the antenna array 100 performs well, and the impendence matching of the antenna array 100 is easy to be adjusted. In addition, the signal transmission part 2 is surrounded by the second, third, and fourth grounding plates 12, 13, 14, and thus the leaking energy of the signal transmission part 2 is blocked by the second, third, and fourth grounding plates 12, 13, 14. Therefore, the effect of the leaking energy of the signal transmission part 2 on the radiation pattern of the radiation conductors 3 is reduced, the leaking energy of the side lobe is reduced, and the gain of the radiated signal is enhanced.

Furthermore, the radiation conductors 31 and 32 are connected to the ends 21 and 22 of the signal transmission part 2, and are isolated by the second, third, fourth grounding plates 12, 13, 14. Thus the interference between the radiation conductors 31 and 32 is reduced.

Figure 3:
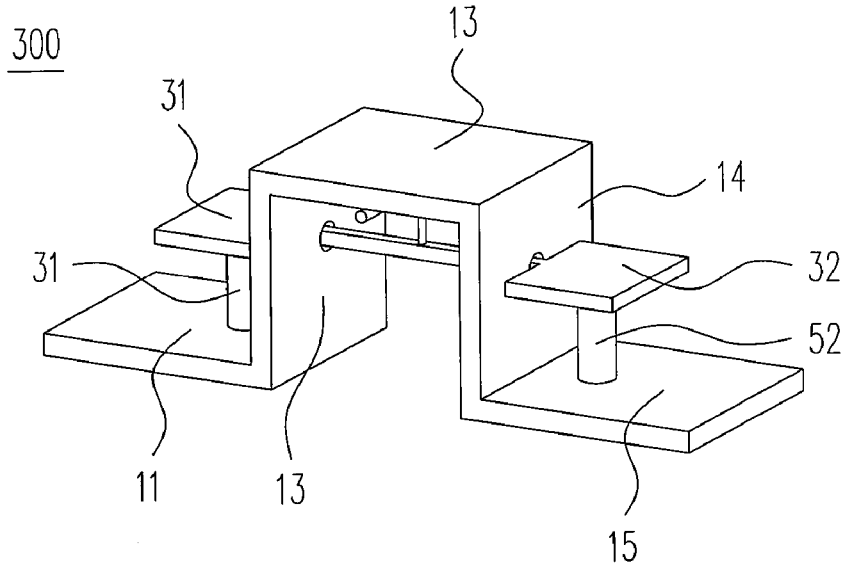
FIG. 3 is a solid schematic diagram showing an antenna array 300 provided by one exemplary embodiment of the present invention, wherein the antenna array 300 further comprises a plurality of supporting pillars 51 and 52.

Please see FIG. 3, FIG. 3 is a solid schematic diagram showing an antenna array 300 provided by one exemplary embodiment of the present invention, wherein the antenna array 300 further comprises a plurality of supporting pillars 51 and 52. The supporting pillars 51 and 52 are made of insulating materials. The supporting pillar 51 is set between the radiation conductor 31 and the first grounding plate 11, which is used for supporting the radiation conductor 31. The supporting pillar 52 is set between the radiation conductor 32 and the fifth grounding plate 15, which is used for supporting the radiation conductor 32. Thus, the signal transmission part 2 connected to the radiation conductors 3 do not touch the second and fourth grounding plates 12, 14, and the destruction of the performance of the antenna array 300 is prevented.

Figure 4:
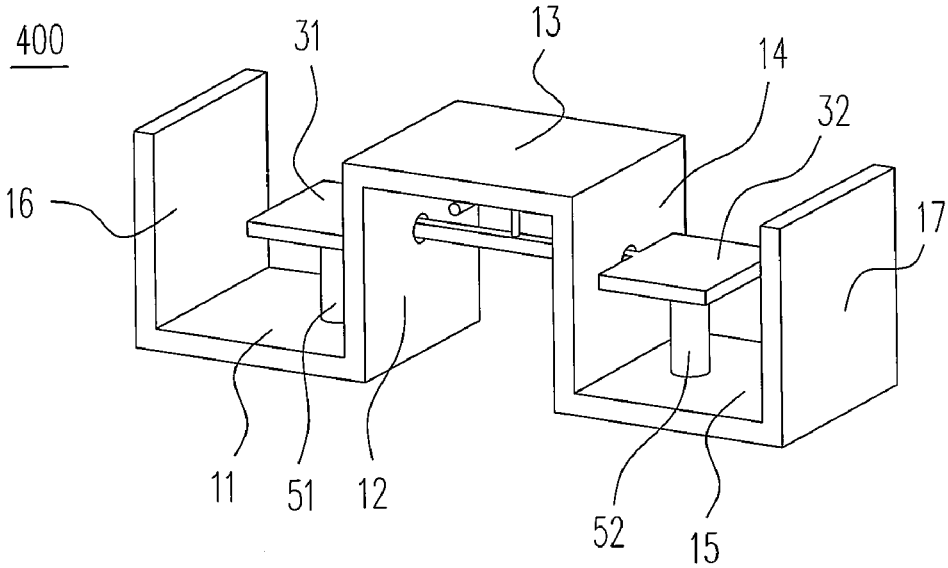
FIG. 4 is a solid schematic diagram showing an antenna array 400 provided by one exemplary embodiment of the present invention, wherein the antenna array 400 further comprises a plurality of grounding plates 16 and 17.

Please see FIG. 4, FIG. 4 is a solid schematic diagram showing an antenna array 400 provided by one exemplary embodiment of the present invention, wherein the antenna array 400 further comprises a plurality of grounding plates 16 and 17. The sixth grounding plate 16 is connected to the first grounding plate 11 and substantially perpendicular with the first grounding plate 11. The seventh grounding plate 17 is connected to the fifth grounding plate 15 and substantially perpendicular with the fifth grounding plate 15. The sixth and seventh grounding plates 16, 17 are substantially parallel with the second and fourth grounding plates 12, 14, and a direction which the sixth grounding plate 16 extends is substantially same as a direction which the seventh grounding plate 17 extends. The radiation conductor 31 is surrounded by the second and sixth grounding plates 12, 16, and the radiation conductor 32 is surrounded by the fourth and seventh grounding plates 14, 17. Hence, the radiations of the radiation conductors 3 are more focusing and not dispersing divergently. Therefore, the radiation gain of the antenna array 400 is enhanced greatly.

Figure 5:
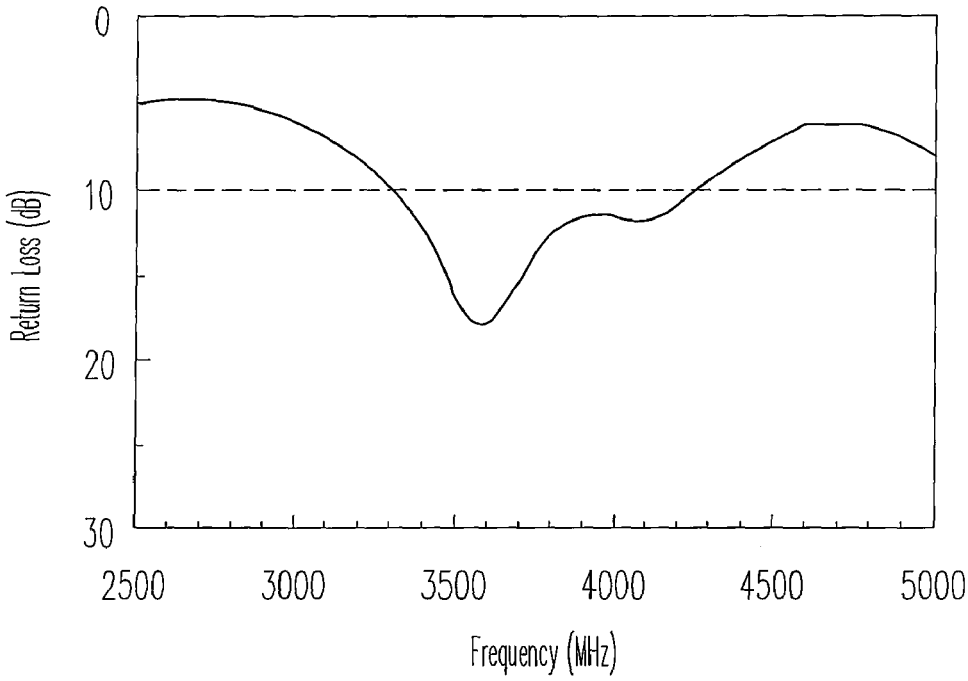
FIG. 5 is a curve diagram showing the relation of the return loss and the frequency of the antenna array 400 provided by one exemplary embodiment of the present invention.

In this embodiment, the first, third, and fifth grounding plates 11, 13, 15 are rectangular metal sheets which lengths and widths are about 5 centimeters. The second and fourth grounding plates 12, 14 are rectangular metal sheets which lengths and heights are about 5 centimeters and about 1 centimeter respectively. The sixth and seventh grounding plates 16, 17 are rectangular metal sheets which sizes are same as that of the second grounding plate 12. The signal transmission part 2 is a rectangular metal sheet which length and width are about 4.5 and 0.5 centimeters, and the radiation conductors 3 are rectangular metal sheets which lengths and widths are about 4.5 and 3.5 centimeters. Please see FIG. 5, FIG. 5 is a curve diagram showing the relation of the return loss and the frequency of the antenna array 400 provided by one exemplary embodiment of the present invention. By the arrangement stated above, the return loss is shown in FIG. 5. In the definition of VSWR (Voltage Standing Wave Ratio) being 2:1, the bandwidth of the antenna array 400 is approaching to 1050 megahertz (3300~4350 megahertz), and the bandwidth of the antenna array 400 covers the bandwidth of the WiMax system (3300~3800 megahertz).

Figure 6:
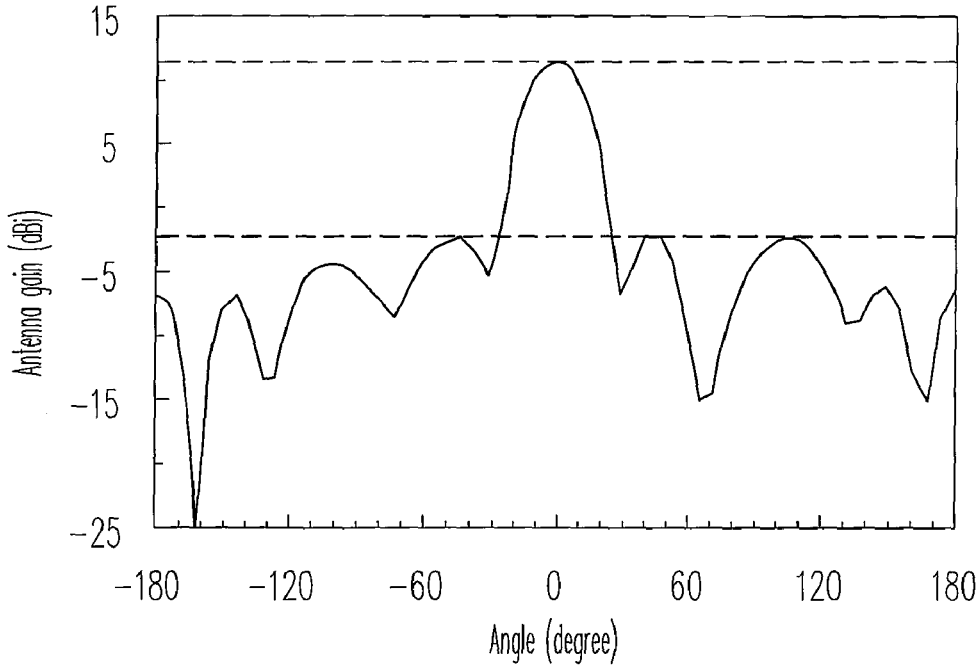
FIG. 6 is curve diagram showing the radiation pattern of the antenna array 400 provided by one exemplary embodiment of the present invention.

Please see FIG. 6, FIG. 6 is curve diagram showing the radiation pattern of the antenna array 400 provided by one exemplary embodiment of the present invention. In FIG. 6, the maximum gain of the main lobe of the radiation can be about 11.5 dBi (defined in 0°), and the maximum gain of the side lobe can be about −2.5 dBi. Hence, the maximum gains of the antenna array 400 are larger than those of the conventional 1×2 antenna array (about 10 dBi). That is, antenna array 400 has high gains. Furthermore, the side-lobe level of the antenna array 400 can be approaching to 14 dB, and the side-lobe level of the antenna array 400 is also higher than that of the conventional 1×2 antenna array (about 10 dB).

Figure 7A:
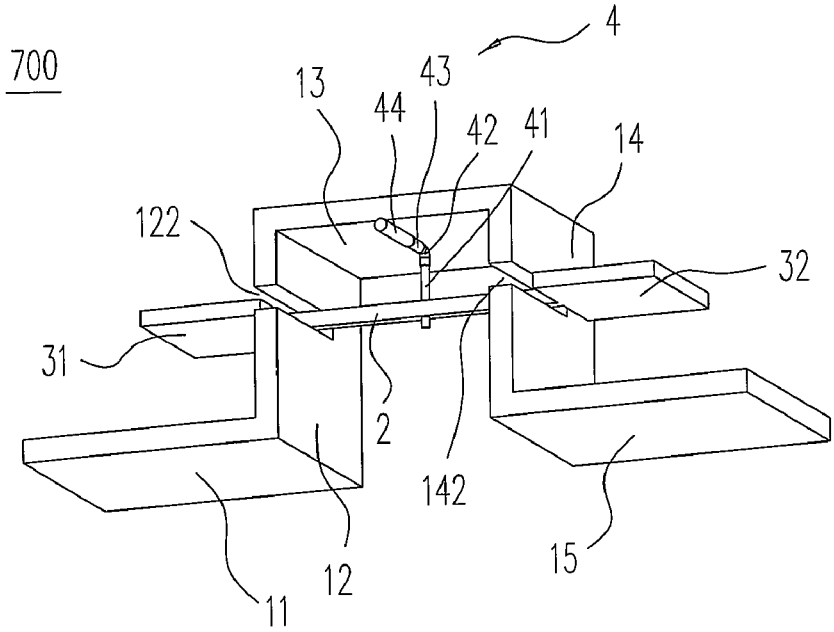
FIG. 7A is a solid schematic diagram showing an antenna array 700 provided by one exemplary embodiment of the present invention, wherein the opening directions of the grooves 122 and 142 are the same.
Figure 7B:
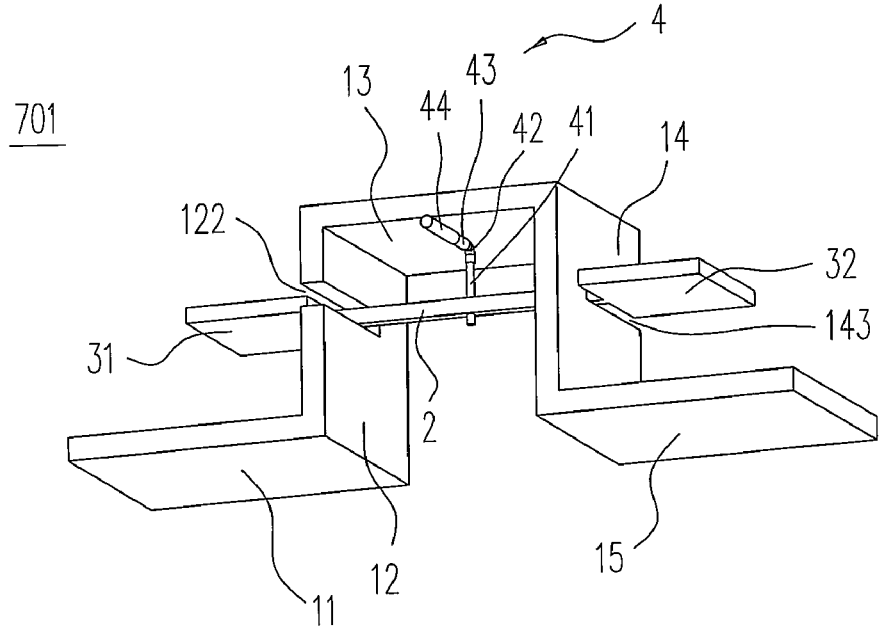
FIG. 7B is a solid schematic diagram showing an antenna array 701 provided by one exemplary embodiment of the present invention, wherein the opening directions of the grooves 122 and 143 are opposite to each other.

Please see FIGS. 7A and 7B, FIG. 7A is a solid schematic diagram showing an antenna array 700 provided by one exemplary embodiment of the present invention, wherein the opening directions of the grooves 122 and 142 are the same. FIG. 7B is a solid schematic diagram showing an antenna array 701 provided by one exemplary embodiment of the present invention, wherein the opening directions of the grooves 122 and 143 are opposite to each other. The difference between antenna array 700 and antenna array 100 is that the holes 121, 141 are changed to the grooves 122, 142. The difference between antenna array 701 and antenna array 100 is that the holes 121, 141 are changed to the grooves 122, 143. By the design concept stated above, the grounding plates 1 can be produced by a single metal sheet, and the signal transmission part 2 and the radiation conductors 3 can be produced by a single metal sheet, too. Therefore, the producing process is simplified, the impendence of the antenna array 700 or 701 is easy to be adjusted, the stability of the product is enhanced, and the producing cost is lowered. As stated above, the opening directions of the grooves 122, 142 are same as each other, and the opening directions of the grooves 122, 143 are opposite to each other. However, these implementations of the grooves 122, 142, 143 are not intended to limit the scope of the present invention. Furthermore, the opening directions of the grooves 122, 142, 143 are substantially parallel with the third grounding plate 13.

Figure 8:
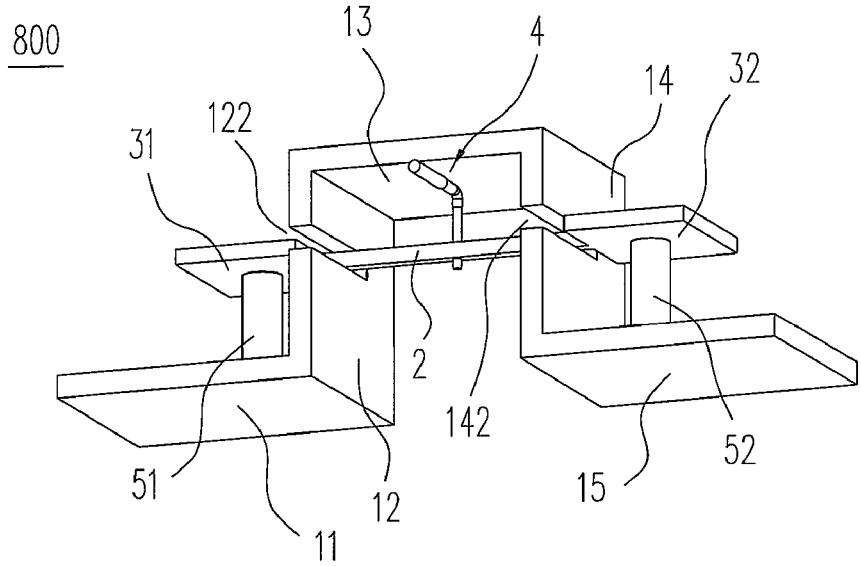
FIG. 8 is a solid schematic diagram showing an antenna array 800 provided by one exemplary embodiment of the present invention, wherein the antenna array 800 further comprises a plurality of supporting pillars 51 and 52.

Referring to FIG. 8, FIG. 8 is a solid schematic diagram showing an antenna array 800 provided by one exemplary embodiment of the present invention, wherein the antenna array 800 further comprises a plurality of supporting pillars 51 and 52. The supporting pillar 51 is set between the radiation conductor 31 and the first grounding plate 11, which is used for supporting the radiation conductor 31. The supporting pillar 52 is set between the radiation conductor 32 and the fifth grounding plate 15, which is used for supporting the radiation conductor 32. Thus, the signal transmission part 2 connected to the radiation conductors 3 do not touch the second and fourth grounding plates 12, 14, and the destruction of the performance of the antenna array 300 is prevented.

Figure 9:
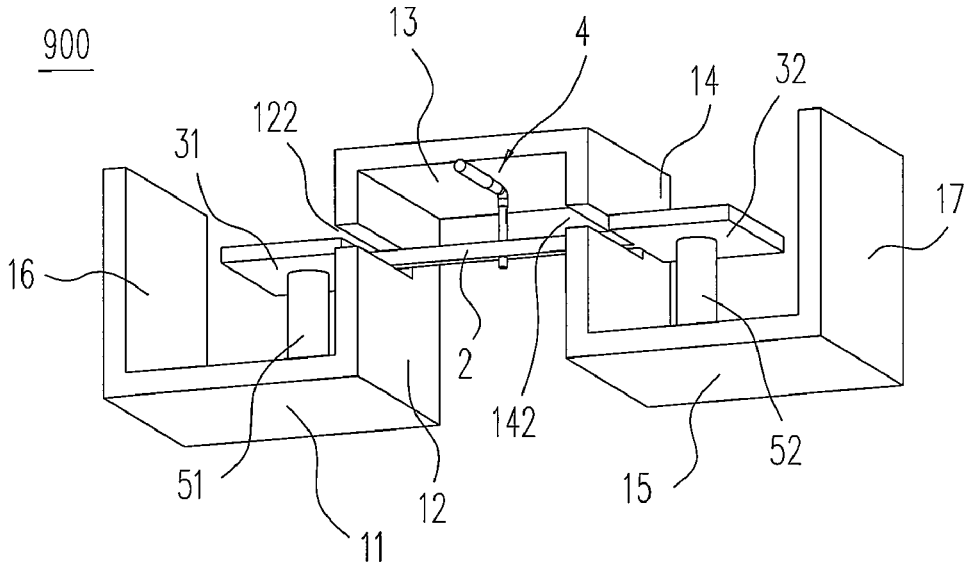
FIG. 9 is a solid schematic diagram showing an antenna array 900 provided by one exemplary embodiment of the present invention, wherein the antenna array 900 further comprises a plurality of grounding plates 16 and 17.

Referring to FIG. 9, FIG. 9 is a solid schematic diagram showing an antenna array 900 provided by one exemplary embodiment of the present invention, wherein the antenna array 900 further comprises a plurality of grounding plates 16 and 17. The sixth grounding plate 16 is connected to the first grounding plate 11 and substantially perpendicular with the first grounding plate 11. The seventh grounding plate 17 is connected to the fifth grounding plate 15 and substantially perpendicular with the fifth grounding plate 15. The sixth and seventh grounding plates 16, 17 are substantially parallel with the second and fourth grounding plates 12, 14, and a direction which the sixth grounding plate 16 extends is substantially same as a direction which the seventh grounding plate 17 extends. The radiation conductor 31 is surrounded by the second and sixth grounding plates 12, 16, and the radiation conductor 32 is surrounded by the fourth and seventh grounding plates 14, 17. Hence, the radiations of the radiation conductors 3 are more focusing and not dispersing divergently. Therefore, the radiation gain of the antenna array 400 is enhanced greatly.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An antenna array, comprising:

a plurality of grounding plates, comprising:

a first and fifth grounding plates, the first and fifth grounding plates are located at a same plane;

a second and fourth grounding plates, the second and fourth grounding plates are connected to the first and fifth grounding plates respectively, substantially perpendicular with the first and fifth grounding plates respectively, and substantially extend with a same direction, further, a first and second holes are sited on the second and fourth grounding plates respectively; and a third grounding plate, connected the between the second and fourth grounding plates, substantially perpendicular with the second and fourth grounding plates;

a signal transmission part, having a first and second ends, passing through the first and second holes, and a direction from the first end to the second end is substantially perpendicular with the second and fourth grounding plates;

a first radiation conductor, connected to the first end, and substantially parallel with the first grounding plate;

a second radiation conductor, connected to the second end, and substantially parallel with the fifth grounding plate; and a signal feed cable, comprising:

a central conductor, connected to the signal transmission part; and an outer conductor, connected to the third grounding plate.

2. The antenna array according to claim 1, further comprising:

at least a first supporting pillar, made by insulating materials, set between the first radiation conductor and the first grounding plate, for supporting the first radiation conductor.

3. The antenna array according to claim 1, further comprising:

at least a second supporting pillar, made by insulating materials, set between the second radiation conductor and the fifth grounding plate, for supporting the second radiation conductor.

4. The antenna array according to claim 1, wherein a position where the central conductor is connected to the signal transmission part is between the second and fourth grounding plates.

5. The antenna array according to claim 1, further comprising:

a sixth grounding plate, connected to the first grounding plate, and substantially perpendicular with the first grounding plate; and a seventh grounding plate, connected to the fifth grounding plate, and substantially perpendicular with the fifth grounding plate;

wherein the sixth and seventh grounding plates are substantially parallel with the second and fourth grounding plates, and a direction which the sixth grounding plate extends is substantially same as a direction which the seventh grounding plate extends.

6. An antenna array, comprising:

a plurality of grounding plates, comprising:

a first and fifth grounding plates, the first and fifth grounding plates are located at a same plane;

a second and fourth grounding plates, the second and fourth grounding plates are connected to the first and fifth grounding plates respectively, substantially perpendicular with the first and fifth grounding plates respectively, and substantially extend with a same direction, further, a first and second grooves are sited on the second and fourth grounding plates respectively; and a third grounding plate, connected the between the second and fourth grounding plates, substantially perpendicular with the second and fourth grounding plates;

a signal transmission part, having a first and second ends, passing through the first and second grooves, and a direction from the first end to the second end is substantially perpendicular with the second and fourth grounding plates;

a first radiation conductor, connected to the first end, and substantially parallel with the first grounding plate;

a second radiation conductor, connected to the second end, and substantially parallel with the fifth grounding plate; and a signal feed cable, comprising:

a central conductor, connected to the signal transmission part; and an outer conductor, connected to the third grounding plate.

7. The antenna array according to claim 6, further comprising:

at least a first supporting pillar, made by insulating materials, set between the first radiation conductor and the first grounding plate, for supporting the first radiation conductor.

8. The antenna array according to claim 6, further comprising:

at least a second supporting pillar, made by insulating materials, set between the second radiation conductor and the fifth grounding plate, for supporting the second radiation conductor.

9. The antenna array according to claim 6, wherein a position where the central conductor is connected to the signal transmission part is between the second and fourth grounding plates.

10. The antenna array according to claim 6, further comprising:

a sixth grounding plate, connected to the first grounding plate, and substantially perpendicular with the first grounding plate; and a seventh grounding plate, connected to the fifth grounding plate, and substantially perpendicular with the fifth grounding plate;

wherein the sixth and seventh grounding plates are substantially parallel with the second and fourth grounding plates, and a direction which the sixth grounding plate extends is substantially same as a direction which the seventh grounding plate extends.

11. The antenna array according to claim 6, wherein an opening direction of the first groove is substantially same as an opening direction of the second groove.

12. The antenna array according to claim 6, wherein an opening direction of the first groove is substantially opposite to an opening direction of the second groove.

* * * * *